US011049461B2

(12) United States Patent
Huang

(10) Patent No.: US 11,049,461 B2
(45) Date of Patent: Jun. 29, 2021

(54) DRIVING METHOD FOR DISPLAY DEVICE AND DISPLAY DEVICE

(71) Applicant: HKC Corporation Limited, Shenzhen (CN)

(72) Inventor: Beizhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/772,996

(22) PCT Filed: Dec. 13, 2017

(86) PCT No.: PCT/CN2017/115785
§ 371 (c)(1),
(2) Date: Jun. 15, 2020

(87) PCT Pub. No.: WO2019/080286
PCT Pub. Date: May 2, 2019

(65) Prior Publication Data

US 2021/0134233 A1 May 6, 2021

(30) Foreign Application Priority Data

Oct. 25, 2017 (CN) ..... 201711007211.8

(51) Int. Cl.
*G09G 3/34* (2006.01)
*G09G 3/36* (2006.01)

(52) U.S. Cl.
CPC ..... *G09G 3/3413* (2013.01); *G09G 3/3607* (2013.01); *G09G 2300/0452* (2013.01); *G09G 2320/0626* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,937,224 | B1 * | 8/2005 | Miyachi | G09G 3/3677 345/102 |
| 7,522,134 | B2 * | 4/2009 | Mizumaki | G09G 3/3406 345/204 |
| 8,279,165 | B2 * | 10/2012 | Yoshida | G09G 3/3648 345/102 |
| 10,347,210 | B2 * | 7/2019 | Guo | G09G 5/10 |
| 2021/0056917 | A1 * | 2/2021 | Yan | G09G 3/3426 |

* cited by examiner

*Primary Examiner* — Van N Chow
(74) *Attorney, Agent, or Firm* — Hemisphere Law, PLLC; Zhigang Ma

(57) ABSTRACT

A driving method for a display device and a display device are provided. The driving method includes setting mean values of the first, second and third components of a first frame of display image to be equal to a second mean value, mean values of the first and third components of a second frame of display image to be equal to a third mean value, a mean value of second components to be zero; adjusting the backlight module brightness according to the mean values of the first, second and third components of an original display image, the first frame and the second frame of display images; obtaining a driving component of the pixel in the second frame of display image according to the backlight module brightness, the component of one pixel in the original display image and the driving component of the pixel in the first frame of display image.

20 Claims, 6 Drawing Sheets

DRIVING METHOD FOR DISPLAY DEVICE AND DISPLAY DEVICE

FIELD OF THE DISCLOSURE

The disclosure relates to a display technical field, and more particularly to a driving method for a display device and a display device.

BACKGROUND

Large-sized liquid crystal displays mostly adopt vertical alignment (VA) liquid crystal or in-plane switching (IPS) liquid crystal technology. The brightness of pixels in the VA type liquid crystal display at large visual angles is rapidly saturated along with the driving voltage, resulting in severe color shift of liquid crystal displays at large visual angles, further affecting the image display quality of liquid crystal displays.

SUMMARY

Accordingly, an embodiment of the disclosure provides a driving method for a display device and a display device to reduce the color shift of the display panel at large visual angles. Meanwhile, the problems of the more visible difference of primary component of low grayscale pixels than other components at the front angle and large visual angles compared with the high grayscale pixels, and the energy consumption of the display device is reduced.

An embodiment of the disclosure provides a driving method for a display device. A frame of original display image of the display device includes at least one region; each of the at least one region includes a number of pixels, the driving method includes: dividing the frame of original display image in the at least one region into a first frame of display image and a second frame of display image; obtaining a first mean value, a second mean value and a third mean value corresponding to the original display image in the at least one region; setting each of the mean values of the first components, the second components and the third components corresponding to the first frame of display image in the at least one region to be equal to the second mean value, setting mean values of the first components and the third components corresponding to the second frame of display image both to be equal to the third mean value, setting a mean value of the second components corresponding to the second frame of display image to be equal to zero; adjusting a brightness of backlight modules according to the mean values of the first components, the second components and the third components each corresponding to the original display image, the first frame of display image and the second frame of display image in the at least one region; obtaining a driving component corresponding to the pixels in the second frame of display image according to brightnesses of the backlight modules before and after adjustment corresponding to the at least one region, the components corresponding to one of the pixels in the original display image and the driving component corresponding to the pixel in the first frame of display image; setting the brightness of the backlight modules corresponding to a predetermined component corresponding to the pixel in the second frame of display image in the at least one region to be zero; driving the pixels in the display device for display according to the driving component corresponding to the pixels in the first frame of display image and the driving component corresponding to the pixels in the second frame of display image in the at least one region.

Each of the pixels in the original display image, the first frame of display image and the second frame of display image includes components corresponding to a predetermined color space. The components include first components, second components and third components.

The first mean value, the second mean value and the third mean value each are mean values of the first components, the second components and the third components corresponding to the original display image, and the first mean value is larger than the second mean value, the second mean value is larger than the third mean value.

The driving component corresponding to the pixel in the first frame of display image is equal to a secondary maximal component corresponding to the pixel in the original display image.

The predetermined component corresponds to the secondary maximal component corresponding to the pixel in the original display image.

Optionally, after obtaining the driving component corresponding to the pixels in the second frame of display image according to the brightnesses of the backlight modules before and after adjustment corresponding to the at least one region, the components corresponding to one of the pixels in the original display image and the driving component corresponding to the pixel in the first frame of display image, the driving method further includes: judging a relation of the driving component corresponding to the pixel in the second frame of display image in the at least one region, zero and the first components corresponding to the pixels in the original display image; when the driving component corresponding to the pixels in the second frame of display image is smaller than zero, setting the driving component corresponding to the pixel in the second frame of display image to be equal to zero; when the driving component corresponding to the pixel in the second frame of display image is larger than a maximal component corresponding to the pixel, setting the driving component corresponding to the pixel in the second frame of display image to be equal to the maximal component corresponding to the pixel.

Optionally, the backlight modules include a first backlight module, a second backlight module and a third backlight module. Adjusting the brightness of the backlight modules according to the mean values of the first components, the second components and the third components each corresponding to the original display image, the first frame of display image and the second frame of display image in the at least one region includes: adjusting a brightness of the first backlight module according to a grayscale brightness value of a mean value of the first components each corresponding to the original display image in the at least one region, the first frame of display image and the second frame of display image; adjusting a brightness of the second backlight module according to a grayscale brightness value of a mean value of the second components each corresponding to the original display image in the at least one region, the first frame of display image and the second frame of display image; adjusting a brightness of the third backlight module according to a grayscale brightness value of a mean value of the third components each corresponding to the original display image in the at least one region, the first frame of display image and the second frame of display image.

Optionally, the backlight modules include a first backlight module, a second backlight module and a third backlight module. Obtaining the driving component corresponding to the pixels in the second frame of display image according to the brightnesses of the backlight modules before and after adjustment corresponding to the at least one region, the components corresponding to one of the pixels in the original display image and the driving component corresponding to the pixel in the first frame of display image includes: obtaining the driving component of the first components corresponding to the pixel in the second frame of display image according to the brightnesses of the first backlight module before and after adjustment corresponding to the at least one region, the first components corresponding to one of the pixels in the original display image and the driving component corresponding to the pixel in the first frame of display image; obtaining the driving component of the second components corresponding to the pixel in the second frame of display image according to the brightnesses of the second backlight module before and after adjustment corresponding to the at least one region, the second components corresponding to one of the pixels in the original display image and the driving component corresponding to the pixel in the first frame of display image; obtaining the driving component of the third components corresponding to the pixel in the second frame of display image according to the brightnesses of the third backlight module before and after adjustment corresponding to the at least one region, the third components corresponding to one of the pixels in the original display image and the driving component corresponding to the pixel in the first frame of display image.

Optionally, the predetermined color space is a red-green-blue (RGB) color space.

Optionally, the first component, the second component and the third component of the predetermined color space each correspond to a red component, a green component and a blue component in the RGB color space.

Optionally, the display device is a liquid crystal display device.

An embodiment of the disclosure provides a display device. A frame of original display image of the display device includes at least one region; each of the at least one region includes a number of pixels. The display device includes: an image division module disposed to divide the frame of original display image in one of the regions into a first frame of display image and a second frame of display image, a mean value obtainment module electrically connected to the image division module, a component setup module electrically connected to the mean value obtainment module, a backlight adjustment module electrically connected to the component setup module, a driving component obtainment module electrically connected to the backlight adjustment module, a backlight setup module electrically connected to the backlight module, and a driving module electrically connected to the driving component obtainment module.

Each of the pixels in the original display image, the first frame of display image and the second frame of display image includes components corresponding to a predetermined color space. The components include first components, second components and third components.

The mean value obtainment module is disposed to obtain a first mean value, a second mean value and a third mean value corresponding to the original display image in the at least one region; the first mean value, the second mean value and the third mean value each are mean values of the first components, the second components and the third components corresponding to the original display image, and the first mean value is larger than the second mean value, the second mean value is larger than the third mean value.

The component setup module is disposed to set each of the mean values of the first components, the second components and the third components corresponding to the first frame of display image in the at least one region to be equal to the second mean value, set mean values of the first components and the third components corresponding to the second frame of display image both to be equal to the third mean value, and set a mean value of the second components corresponding to the second frame of display image to be equal to zero.

The backlight adjustment module is disposed to adjust a brightness of backlight modules according to the mean values of the first components, the second components and the third components each corresponding to the original display image, the first frame of display image and the second frame of display image in the at least one region.

The driving component obtainment module is disposed to obtain a driving component corresponding to the pixels in the second frame of display image according to brightnesses of the backlight modules before and after adjustment corresponding to the at least one region, the components corresponding to one of the pixels in the original display image and the driving component corresponding to the pixel in the first frame of display image; the driving component corresponding to the pixel in the first frame of display image is equal to a secondary maximal component corresponding to the pixel in the original display image.

The backlight setup module is disposed to set the brightness of the backlight modules corresponding to a predetermined component corresponding to the pixel in the second frame of display image in the at least one region to be zero; the predetermined component corresponds to the secondary maximal component corresponding to the pixel in the original display image.

The display device is optional to include: a component judgement module disposed to judge a relation of the driving component corresponding to the pixel in the second frame of display image in the at least one region, zero and the first components corresponding to the plurality of pixels in the original display image after obtaining the driving component corresponding to the plurality of pixels in the second frame of display image according to the brightnesses of the backlight modules before and after adjustment corresponding to the at least one region, the components corresponding to one of the plurality of pixels in the original display image and the driving component corresponding to the pixel in the first frame of display image When the driving component corresponding to the pixels in the second frame of display image is smaller than zero, the driving component corresponding to the pixel in the second frame of display image is set to be equal to zero.

When the driving component corresponding to the pixel in the second frame of display image is larger than a maximal component corresponding to the pixel, the driving component corresponding to the pixel in the second frame of display image is set to be equal to the maximal component corresponding to the pixel.

Optionally, the backlight modules include a first backlight module, a second backlight module and a third backlight module. The backlight adjustment module is configured for: adjusting a brightness of the first backlight module according to a grayscale brightness value of a mean value of the first components each corresponding to the original display image in the at least one region, the first frame of display image and the second frame of display image; adjusting a brightness of the second backlight module according to a grayscale brightness value of a mean value of the second components each corresponding to the original display image in the at least one region, the first frame of display image and the second frame of display image; adjusting a brightness of the third backlight module according to a grayscale brightness value of a mean value of the third components each corresponding to the original display image in the at least one region, the first frame of display image and the second frame of display image.

Optionally, the backlight modules include a first backlight module, a second backlight module and a third backlight module. The driving component obtainment module is configured for: obtaining the driving component of the first components corresponding to the pixel in the second frame of display image according to the brightnesses of the first backlight module before and after adjustment corresponding to the at least one region, the first components corresponding to one of the pixels in the original display image and the driving component corresponding to the pixel in the first frame of display image; obtaining the driving component of the second components corresponding to the pixel in the second frame of display image according to the brightnesses of the second backlight module before and after adjustment corresponding to the at least one region, the second components corresponding to one of the pixels in the original display image and the driving component corresponding to the pixel in the first frame of display image; obtaining the driving component of the third components corresponding to the pixel in the second frame of display image according to the brightnesses of the third backlight module before and after adjustment corresponding to the at least one region, the third components corresponding to one of the pixels in the original display image and the driving component corresponding to the pixel in the first frame of display image.

Optionally, the predetermined color space is an RGB color space.

Optionally, the first component, the second component and the third component of the predetermined color space each correspond to a red component, a green component and a blue component in the RGB color space.

Optionally, the display device is a liquid crystal display device.

An embodiment of the disclosure provides a driving method for a display device. A frame of original display image of the display device includes at least one region; each of the at least one region includes a number of pixels. The driving method includes: dividing the frame of original display image in the at least one region into a first frame of display image and a second frame of display image; obtaining a first mean value, a second mean value and a third mean value corresponding to the original display image in the at least one region; setting each of the mean values of the first components, the second components and the third components corresponding to the first frame of display image in the at least one region to be equal to the second mean value, setting mean values of the first components and the third components corresponding to the second frame of display image both to be equal to the third mean value, setting a mean value of the second components corresponding to the second frame of display image to be equal to zero; adjusting a brightness of the first backlight module according to a grayscale brightness value of a mean value of the first components each corresponding to the original display image in the at least one region, the first frame of display image and the second frame of display image; adjusting a brightness of the second backlight module according to a grayscale brightness value of a mean value of the second components each corresponding to the original display image in the at least one region, the first frame of display image and the second frame of display image; adjusting a brightness of the third backlight module according to a grayscale brightness value of a mean value of the third components each corresponding to the original display image in the at least one region, the first frame of display image and the second frame of display image; obtaining the driving component of the first components corresponding to the pixel in the second frame of display image according to the brightnesses of the first backlight module before and after adjustment corresponding to the at least one region, the first components corresponding to one of the pixels in the original display image and the driving component corresponding to the pixel in the first frame of display image; obtaining the driving component of the second components corresponding to the pixel in the second frame of display image according to the brightnesses of the second backlight module before and after adjustment corresponding to the at least one region, the second components corresponding to one of the pixels in the original display image and the driving component corresponding to the pixel in the first frame of display image; obtaining the driving component of the third components corresponding to the pixel in the second frame of display image according to the brightnesses of the third backlight module before and after adjustment corresponding to the at least one region, the third components corresponding to one of the pixels in the original display image and the driving component corresponding to the pixel in the first frame of display image; setting the brightness of the backlight modules corresponding to a predetermined component corresponding to the pixel in the second frame of display image in the at least one region to be zero; driving the pixels in the display device for display according to the driving components of the first components, the second components and the third components corresponding to the pixel in the first frame of display image in the at least one region and the driving components of the first components, the second components and the third components corresponding to the pixel in the second frame of display image.

Each of the pixels in the original display image, the first frame of display image and the second frame of display image includes components corresponding to a predetermined color space; the components include first components, second components and third components.

The first mean value, the second mean value and the third mean value each are mean values of the first components, the second components and the third components corresponding to the original display image, and the first mean value is larger than the second mean value, the second mean value is larger than the third mean value.

Each of the driving components corresponding to the first components, the second components and the third components of the pixel in the first frame of display image is equal to a secondary maximal component corresponding to the pixel in the original display image.

The predetermined component corresponds to the secondary maximal component corresponding to the pixel in the original display image.

Optionally, after obtaining the driving component of the third components corresponding to the pixel in the second frame of display image according to the brightnesses of the third backlight module before and after adjustment corresponding to the at least one region, the third components corresponding to one of the pixels in the original display image and the driving component corresponding to the pixel in the first frame of display image, the driving method further includes: judging a relation of the driving component corresponding to the pixel in the second frame of display image in the at least one region, zero and the first components corresponding to the pixels in the original display image; when the driving component corresponding to the pixels in the second frame of display image is smaller than zero, setting the driving component corresponding to the pixel in the second frame of display image to be equal to zero; when the driving component corresponding to the pixel in the second frame of display image is larger than a maximal component corresponding to the pixel, setting the driving component corresponding to the pixel in the second frame of display image to be equal to the maximal component corresponding to the pixel.

Optionally, the predetermined color space is an RGB color space.

Optionally, the first component, the second component and the third component of the predetermined color space each correspond to a red component, a green component and a blue component in the RGB color space.

Optionally, the display device is a liquid crystal display device.

An embodiment of the disclosure further provides a storage medium readable over computer stored with an executable command over computer. The executable command over computer executes the driving method any one of the methods above.

An embodiment of the disclosure further provides a display device. The display device includes one or more processor(s), a memory and one or more program(s). The one or more program(s) is/are stored in the memory, the method above is executed during operation by one or more processor(s).

An embodiment of the disclosure further provides a computer program product.

The computer program product includes computer programs stored in a non-transient storage medium readable over computer. The computer programs include program commands. When the program commands are executed by the computer, the computer is made to execute any one of the methods above.

DETAILED DESCRIPTION OF PREFERRED EMBODIMENTS

A display panel of a display device includes numerous color combinations. The color displayed by the display panel is the color combination of the display panel. Taking the display panel with red combinations as an example, red components of pixels in the display panel are more obvious than blue components and green components of pixels in the display panel at the front angle, but the red components of pixels in the display panel are severely reduced compared with the blue components and the green components of pixels in the display panel at large visual angles, and the color shown by the display panel will be further departed from red when the red components of pixels in the display panel are fewer compared with the blue components and the green components of pixels in the display panel, namely the color shift at large visual angles and the front angle is more severe, and the color shift problem of the display panel is more considerable.

Moreover, still taking the display panel with red combinations as an example, the difference of red components of low grayscale pixels is more visible than blue components and green components at the front angle and large visual angles compared with the difference of high grayscale pixels, and the color shift is more severe.

Figure 1:
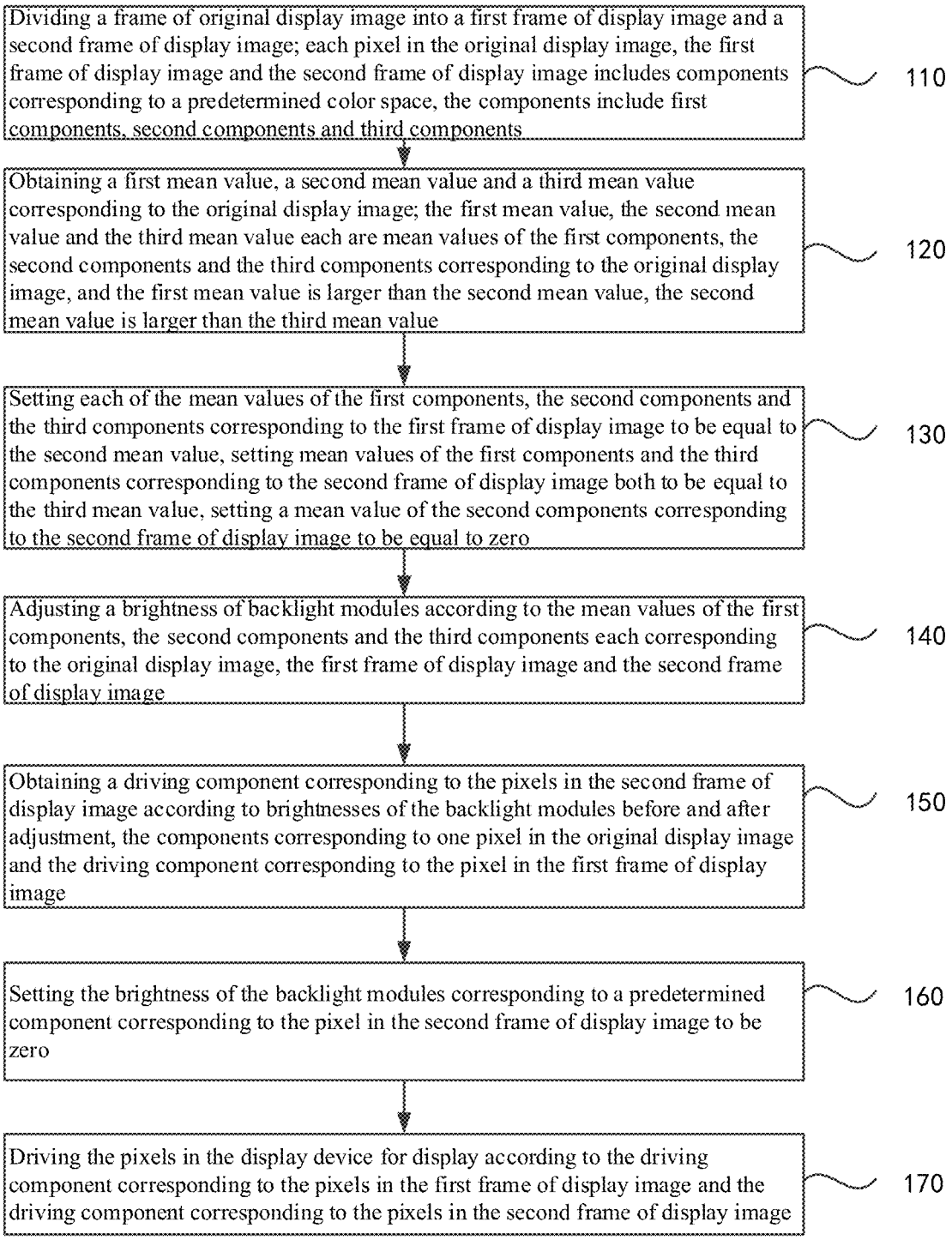
FIG. 1 is a schematic flowchart of a driving method for a display device according to an embodiment.

FIG. 1 is a schematic flowchart of a driving method for a display device according to an embodiment of the disclosure. The driving method can be applied in circumstances in need for driving display panel for display, and fulfilled by the display device provided by the embodiment of the disclosure. A frame of original display image of the display device includes at least one region, and each of the regions includes multiple pixels. When pixels of one frame of original display image of the display device in one region, the method includes:

step 110, dividing one frame of original display image into a first frame of display image and a second frame of display image; each of the pixels in the original display image, the first frame of display image and the second frame of display image includes components corresponding to a predetermined color space; the components include first components, second components and third components.

Exemplarily, the predetermined color space can be set to be the RGB color space; the first component, the second component and the third component each correspond to a red component, a green component and a blue component in the RGB color space.

Step S120, obtaining a first mean value, a second mean value and a third mean value corresponding to the original display image. The first mean value, the second mean value and the third mean value each are mean values of the first components, the second components and the third components corresponding to the original display image, and the first mean value is larger than the second mean value; the second mean value is larger than the third mean value.

Each of the pixels in the original display image corresponds to the first components, the second components and the third components. A mean value of the first components corresponding to all the pixels in the original display image can be set to be the first mean value corresponding to the original display image; a mean value of the second components corresponding to all the pixels in the original display image can be set to be the second mean value corresponding to the original display image; a mean value of the third components corresponding to all the pixels in the original display image can be set to be the third mean value corresponding to the original display image, and the first mean value is larger than the second mean value; the second mean value is larger than the third mean value. Exemplarily, the first component, the second component and the third component each can be set to correspond to the red component, the green component and the blue component in the RGB color space, and the display panel is the red combination, namely the display panel entirely shows red.

Step 130, setting the mean values of the first components, the second components and the third components corresponding to the first frame of display image each are equal to the second mean value, setting mean values of the first components and the third components corresponding to the second frame of display image to be the third mean value. The mean value of the second components corresponding to the second frame of display image is equal to zero.

Exemplarily, the first mean value corresponding to the original display image can be set to be A; the second mean value can be B; the third mean value can be C; A is larger than B, and B is larger than C. The mean values of the first components, the second components and the third components corresponding to the first frame of display image can be set to be B; the mean values of the first components and the third components corresponding to the second frame of display image can be set to be C; the mean value of the second components corresponding to the second frame of display image can be set to be zero. As the mean value of the second components corresponding to the first frame of display image is equal to the mean value B of the second components corresponding to the original display image, the mean value of the second components corresponding to the second frame of display image can be set to be zero.

Step 140, adjusting the brightness of backlight modules according to the mean value of the first components, the second components and the third components each corresponding to the original display image, the first frame of display image and the second frame of display image.

Exemplarily, the backlight modules can be set to include a first backlight module, a second backlight module and a third backlight module; the brightness of the first backlight module can be adjusted according to grayscale brightness values of mean values of the first components each corresponding to the original display image, the first frame of display image and the second frame of display image. The brightness of the second backlight module is adjusted according to grayscale brightness values of mean values of the second components each corresponding to the original display image, the first frame of display image and the second frame of display image. The brightness of the third backlight module is adjusted according to grayscale brightness values of mean values of the third components each corresponding to the original display image, the first frame of display image and the second frame of display image.

Exemplarily, the first component, the second component and the third component each can be set to correspond to the red component, the green component and the blue component in the RGB color space; the first backlight module, the second backlight module and the third backlight module each are the red backlight module, the green backlight module and the blue backlight module. The brightness of the red backlight module is adjusted according to the grayscale brightness values of mean values of the red components each corresponding to the original display image, the first frame of display image and the second frame of display image. The brightness of the green backlight module is adjusted according to the grayscale brightness values of mean values of the green components each corresponding to the original display image, the first frame of display image and the second frame of display image. The brightness of the blue backlight module is adjusted according to the grayscale brightness values of mean values of the blue components each corresponding to the original display image, the first frame of display image and the second frame of display image.

Referring to the step 130, grayscale brightness values of the mean value A of the first components, the mean value B of the second components and the mean value C of the third components corresponding to the original display image can be set to be TR1(A), TG1(B) and TB1(C) at the front angle. Grayscale brightness values of the mean value of the first components, the mean value of the second components and the mean value of the third components corresponding to the first frame of display image each are TR2(B), TG2(B) and TB2(B). Grayscale brightness values corresponding to the mean value of the first components, the mean value of the second components and the mean value of the third components corresponding to the second frame of display image each are TR3(C), TG3(0) and TB3(C). The brightness of the first backlight module, the second backlight module and the third backlight module before adjustment each can be set to be AR, AG and AB; the brightness of the first backlight module, the second backlight module and the third backlight module after adjustment AR1, AG1 and AB1 can satisfy following computational formulas:

$$AR1 = 2 \times AR \times \frac{TR1(A)}{TR2(B) + TR3(C)}$$

$$AG1 = 2 \times AG \times \frac{TG1(B)}{TG2(B) + TG3(0)} = 2 \times AG$$

$$AB1 = 2 \times AB \times \frac{TB1(C)}{TB2(B) + TB3(C)}$$

As one frame of original display image is divided into the first frame of display image and the second frame of display image, the display time of each frame of display image turns to be a half of one frame of display image, and in the formula above, besides considering the factor of components, the brightness of the backlight module before adjustment should be multiplied by two, namely the alternation of display time is offset by adjusting the brightness of the backlight module.

Exemplarily, A is set to be 100, B is equal to 80, and C is 40; namely the mean value of the first components, the mean value of the second components and the mean value of the third components corresponding to the original display image each are 100, 80 and 40. The mean value of the first components, the mean value of the second components and the mean value of the third components corresponding to the first frame of display image each can be set to be 80; the mean value of the first components and the mean value of the third components corresponding to the second frame of display image each can be set to be 40; the mean value of the second components corresponding to the second frame of display image is 0.

Exemplarily, referring to the photoelectrical characteristic of the VA type liquid crystal display panel, taking the data format of grayscale values is 8 bit (the grayscale value is 0-255 grayscale) as an example, the grayscale brightness and grayscale values satisfy the following formula:

$$Y = \left(\frac{X}{255}\right)^{2.2}$$

X represents the grayscale value, namely the component mentioned in the embodiments above; Y depicts the grayscale brightness, namely normalization brightness, as well as the grayscale brightness value of the mean value of components mentioned in the embodiments above. X and Y satisfy a relational formula with exponent 2.2; the required grayscale brightness can be obtained by searching table or the formula above. TR1(A), TG1(B) and TB1(C) each are 13.3%, 7.4% and 1.7%; TR2(B), TG2(B) and TB2(B) each are 8.2%, 7.4% and 7.4%; TR3(C), TG3(0) and TB3(C) each are 1.8%, 0 and 1.7%. AR1 is equal to 2.66 times of AR, AG1 is equal to twice of AG, and AB1 is equal to 0.347 times of AB according to the formula above.

Exemplarily, referring to the photoelectrical characteristic of the VA type liquid crystal display panel, the grayscale values and grayscale brightness satisfy the relational formula with exponent 2.2 above at the front angle. The grayscale values and the grayscale brightness are corresponding at side visual angles as well, relatively to the pixel design of the VA type liquid crystal display panel. Exemplarily, the side visual angles satisfy following conditions: when the mean value A of the first components, the mean value B of the second components and the mean value C of the third components corresponding to the original display image each are 100, 80 and 40, the mean value of the first components, the mean value of the second components and the mean value of the third components corresponding to the first frame of display image each are 80, the mean value of the first components and the mean value of the third components corresponding to the second frame of display image each are 40, and the mean value of the second components corresponding to the second frame of display image is 0, the grayscale brightness values TR1(A), TG1(B) and TB1(C) of three components of each pixel in the original display image each are 39%, 34.7% and 23.1%, the grayscale brightness values TR2(B), TG2(B) and TB2(B) of three components of each pixel in the first frame of display image each are 32.6%, 34.7% and 42.1%, and the grayscale brightness values TR3(C), TG3(0) and TB3(C) of three components of each pixel in the second frame of display image each are 17.6%, 0 and 23.1%. Aiming at the first frame of display image and the second frame of display image, a ratio D1 of grayscale brightness values of the first components, a ratio D2 of grayscale brightness values of the second components and a ratio D3 of grayscale brightness values of the third components satisfy following formulas:

$$D1=2.66\times[TR2(B)+TR3(C)]$$

$$D2=2\times[TG2(B)+TG3(0)]$$

$$D3=0.374\times[TB2(B)+TB3(C)]$$

The parameters are brought into the computational formulas of D1, D2 and D3 above to obtain D1 is equal to 133.5%, D2 is equal to 69.4%, D3 is equal to 24.4%; TR1(A), TG1(B) and TB1(B) at side visual angles each are 39%, 34.7% and 23.1%. A ratio of the red components to the green components is raised from 1.124 according to a ratio of 39% to 34.7% to 1.924 obtained by a ratio of 133.5% to 69.4%; a ratio of the red components to the blue components is raised from 1.688 obtained by a ratio of 39% to 23.1% to 5.471 obtained by a ratio of 133.5% to 24.4%; the component of primary color, such as the ratio of grayscale brightness values of red components, is effectively enhanced, and the ratio of grayscale brightness values of the primary color component compared with other components at side visual angles is raised to allow the color shown by the display panel to approach the primary color for reducing the color shift of display panels at large visual angles. The problems of the more visible difference of primary component of low grayscale pixels than other components at the front angle and large visual angles compared with the high grayscale pixels and the color shift of display panel at large visual angles can be prevented.

Step 150, obtaining a driving component corresponding to one pixel in the second frame of display image according to the brightness of the backlight module before and after adjustment, the component corresponding to the pixel in the original display image and the driving component corresponding to the pixel in the first frame of display image. The driving component corresponding to the pixel in the first frame of display image is equal to a secondary maximal component corresponding to the pixel in the original display image.

Exemplarily, the backlight module can be set to include the first backlight module, the second backlight module and the third backlight module. The driving component corresponding to the first component of the pixel in the second frame of display image is obtained according to the brightness of the first backlight module before and after adjustment, the first component corresponding to the pixel in the original display image and the driving component corresponding to the pixel in the first frame of display image. The driving component corresponding to the second component of the pixel in the second frame of display image is obtained according to the brightness of the second backlight module before and after adjustment, the second component corresponding to the pixel in the original display image and the driving component corresponding to the pixel in the first frame of display image. The driving component corresponding to the third component of the pixel in the second frame of display image is obtained according to the brightness of the third backlight module before and after adjustment, the third component corresponding to the pixel in the original display image and the driving component corresponding to the pixel in the first frame of display image.

Exemplarily, the first component, the second component and the third component each can be set to correspond to the red component, the green component and the blue component in the RGB color space; the first backlight module, the second backlight module and the third backlight module each are the red backlight module, the green backlight module and the blue backlight module. The driving component of the red components corresponding to the pixel in the second frame of display image is obtained according to the brightness of the red backlight module before and after adjustment, the red component corresponding to one pixel in the original display image and the driving component corresponding to the pixel in the first frame of display image. The driving component corresponding to the green components of the pixel in the second frame of display image is obtained according to the brightness of the green backlight module before and after adjustment, the green component corresponding to one pixel in the original display image and the driving component corresponding to the pixel in the first frame of display image. The driving component corresponding to the blue components of the pixel in the second frame of display image is obtained according to the brightness of the blue backlight module before and after adjustment, the blue component corresponding to one pixel in the original display image and the driving component corresponding to the pixel in the first frame of display image.

Referring to the step 130 and the step 140, a first condition is the comparison in values of the first component, the second component and the third component corresponding to the pixel in the original display image and the comparison in values of the mean value of the first components, the mean value of the second components and the mean value of the third components corresponding to the original display image are the same, namely the mean value of the first components is larger than the mean value of the second components corresponding to the original display image; the mean value of the second components is larger than the mean value of the third components. The first components are larger than the second components corresponding to the pixel in the original display image, and the second components are larger than the third components.

Exemplarily, the first component, the second component and the third component corresponding to the pixel in the original display image can be set to be A1, B1 and C1, and A1 is larger than B1, B1 is larger than C1; three corresponding grayscale brightness values each are TR1(A1), TG1(B1) and TB1(C1). The driving component corresponding to the first component, the driving component corresponding to the second component and the driving component corresponding to the third component of the pixel in the first frame of display image each are set to be B1, namely the driving component corresponding to the pixel in the first frame of display image is equal to the secondary maximal component corresponding to the pixel in the original display image; three corresponding grayscale brightness values each are TR2(B1), TG2(B1) and TB2(B1). Combined with the computational formulas of the brightness AR1, AG1 and AB1 of the backlight modules after adjustment, the driving component TR3 corresponding to the first components of the pixel, the driving component TG3 corresponding to the second components of the pixel and the driving component TB3 corresponding to the third components of the pixel in the second frame of display image satisfy following formulas:

$$TR3 = \frac{2AR \times TR1(A1)}{AR1} - TR2(B1) = \frac{TR1(A1) \times [TR2(B) + TR3(C)]}{TR1(A)} - TR2(B1)$$

$$TG3 = \frac{2AG \times TG1(B1)}{AG1} - TG2(B1) = \frac{TG1(B1) \times [TG2(B) + TG3(0)]}{TG1(B)} - TG2(B1) = 0$$

$$TB3 = \frac{2AB \times TB1(C1)}{AB1} - TB2(B1) = \frac{TB1(C1) \times [TB2(B) + TB3(C)]}{TB1(C)} - TB2(B1)$$

A second condition is the comparison in values of the first component, the second component and the third component corresponding to the pixel in the original display image and the comparison in values of the mean value of the first components, the mean value of the second components and the mean value of the third components corresponding to the original display image are different. Exemplarily, the mean value of the first components is larger than the mean value of the second components corresponding to the original display image; the mean value of the second components is larger than the mean value of the third components.

Exemplarily, the first component, the second component and the third component corresponding to the pixel in the original display image can be set to be A2, B2 and C2, and B2>C2>A2; three corresponding grayscale brightness values are TR1(A2), TG1(B2) and TB1(C2). The driving component corresponding to the first components, the driving component corresponding to the second components and the driving component corresponding to the third components of the pixel in the first frame of display image are set to be C2, C2 and C2, namely the driving component corresponding to the pixel in the first frame of display image is set to be equal to the secondary maximal component C2 corresponding to the pixel in the original display image; three corresponding grayscale brightness values are TR2(C2), TG2(C2) and TB2(C2). Combined with the computational formulas of the brightness AR1, AG1 and AB1 of the backlight modules after adjustment, the driving component TR31 corresponding to the first components of the pixel, the driving component TG31 corresponding to the second components of the pixel and the driving component TB31 corresponding to the third components of the pixel in the second frame of display image satisfy following formulas:

$$TR31 = \frac{2AR \times TR1(A2)}{AR1} - TR2(C2) = \frac{TR1(A2) \times [TR2(B) + TR3(C)]}{TR1(A)} - TR2(C2)$$

$$TG31 = \frac{2AG \times TG1(B2)}{AG1} - TG2(C2) = \frac{TG1(B2) \times [TG2(B) + TG3(0)]}{TG1(B)} - TG2(C2) = TG1(B2) - TG2(C2)$$

$$TB31 = \frac{2AB \times TB1(C2)}{AB1} - TB2(C2) = \frac{TB1(C2) \times [TB2(B) + TB3(C)]}{TB1(C)} - TB2(BC2)$$

Optionally, after obtaining the driving component corresponding to each pixel in the second frame of display image, the relation of the obtained driving component corresponding to the pixel in the second frame of display image, zero and the first component corresponding to the pixel in the original display image should be judged. If the obtained driving component corresponding to the pixel in the second frame of display image is smaller than zero, the driving component corresponding to the pixel in the second frame of display image is set to be zero; if the obtained driving component corresponding to the pixel in the second frame of display image is larger than the maximal component corresponding to the pixel, the driving component corresponding to the pixel in the second frame of display image is equal to the maximal component corresponding to the pixel.

Aiming at the second condition above, as the comparison in values of the first component, the second component and the third component corresponding to the pixel in the original display image and the comparison in values of the mean value of the first components, the mean value of the second components and the mean value of the third components corresponding to the original display image are different, TR31, TG31 and TB31 obtained according to the formulas above can be smaller than zero, or larger than the maximal component corresponding to the pixel in the original image; taking 8 bit grayscale value as an example, the maximal component can be 255 grayscales. As a result, before determining the second component, the relation of the driving component corresponding to the pixel in the second frame of display image and zero, as well as the maximal component corresponding to the pixel, such as 8 bit grayscale value, the maximal component can be 255 grayscales, should be judged; when the driving component corresponding to the pixel in the obtained second frame of display image is smaller than zero, the driving component corresponding to the pixel in the second frame of display image is set to be zero; when the driving component corresponding to the pixel in the obtained second frame of display image is larger than the maximal component corresponding to the pixel, taking 8 bit as an example, the maximal component can be 255 grayscales, the driving component corresponding to the pixel in the second frame of display image is set to be equal to the maximal component corresponding to the pixel, so as to ensure the pixels in the display panel to work.

Step 160, setting the brightness of the backlight module corresponding to the predetermined component corresponding to the pixel in the second frame of display image to be zero. The predetermined component corresponds to the secondary maximal component corresponding to the pixel in the original display image.

Referring to the step 150, aiming at the first condition, namely when the comparison in values of the first component, the second component and the third component corresponding to the pixel in the original display image and the comparison in values of the mean value of the first components, the mean value of the second components and the mean value of the third components corresponding to the original display image are the same, taking the first component, the second component and the third component each corresponding to the red component, the green component and the blue component in the RGB color space as an example, the grayscale brightness value TG3 of the green component corresponding to the pixel in the obtained second frame of display image always is zero; if the green backlight module corresponding to the pixel still emits light, the energy will be wasted. The brightness of the backlight module corresponding to the predetermined component corresponding to the pixel in the second frame of display image is set to be zero for saving energy. The predetermined component corresponding to the pixel in the second frame of display image corresponds to the secondary maximal component corresponding to the pixel in the original display image.

Referring to step 150, aiming at the second condition, namely when the comparison in values of the first component, the second component and the third component corresponding to the pixel in the original display image and the comparison in values of the mean value of the first components, the mean value of the second components and the mean value of the third components corresponding to the original display image are different, taking the first component, the second component and the third component each corresponding to the red component, the green component and the blue component in the RGB color space as an example, the grayscale brightness value of the green component corresponding to the pixel in the obtained second frame of display image is TG31=TG1(B2)−TG2(C2), namely TG31 is unequal to zero. The predetermined component of the secondary maximal component corresponding to the pixel in the original display image corresponding to the second frame of display image is set; the corresponding brightness of the backlight module is zero, which may prevent the pixels in the display device corresponding to the pixel from correctly displaying, but as the first mean value is larger than the second mean value corresponding to the original display image, the second mean value is larger than the third mean value, namely the color shown by the display panel entirely is red. The relation of the first component, the second component and the third component corresponding to extremely few pixels is different from the relation of the mean value of the first components, the mean value of the second components and the mean value of the third components corresponding to the original display image, therefore, the predetermined component of the secondary maximal component corresponding to the pixel corresponding to the original display image in the second frame of display image is set, and the corresponding brightness of the backlight module is zero, resulting in no influence on the output result of the entire image.

Step 170, displaying by driving pixels in the display device according to the driving component corresponding to the pixel in the first frame of display image and the driving component corresponding to the pixel in the second frame of display image.

The component is the grayscale value; each grayscale value corresponds to a driving voltage of the pixel. When the relation in values of the first component, the second component and the third component corresponding to the pixel in the original display image is identical to the relation in values of the mean value of the first components, the mean value of the second components and the mean value of the third components corresponding to the original display image, the grayscale values of the driving components TR3, TG3 and TB3 corresponding to the pixel in the second frame of display image obtained according to the formulas above, and the driving component B1 corresponding to the pixel in the first frame of display image each drive red pixels, green pixels and blue pixels in the display device for displaying.

When the comparison in values of the first component, the second component and the third component corresponding to the pixel in the original display image and the comparison in values of the mean value of the first components, the mean value of the second components and the mean value of the third components corresponding to the original display image are different, the grayscale values of the driving components TR31, TG31 and TB31 corresponding to the pixel in the second frame of display image obtained according to the formulas above, and the driving component C2 corresponding to the pixel in the first frame of display image each drive red pixels, green pixels and blue pixels in the display device for displaying.

Figure 2:
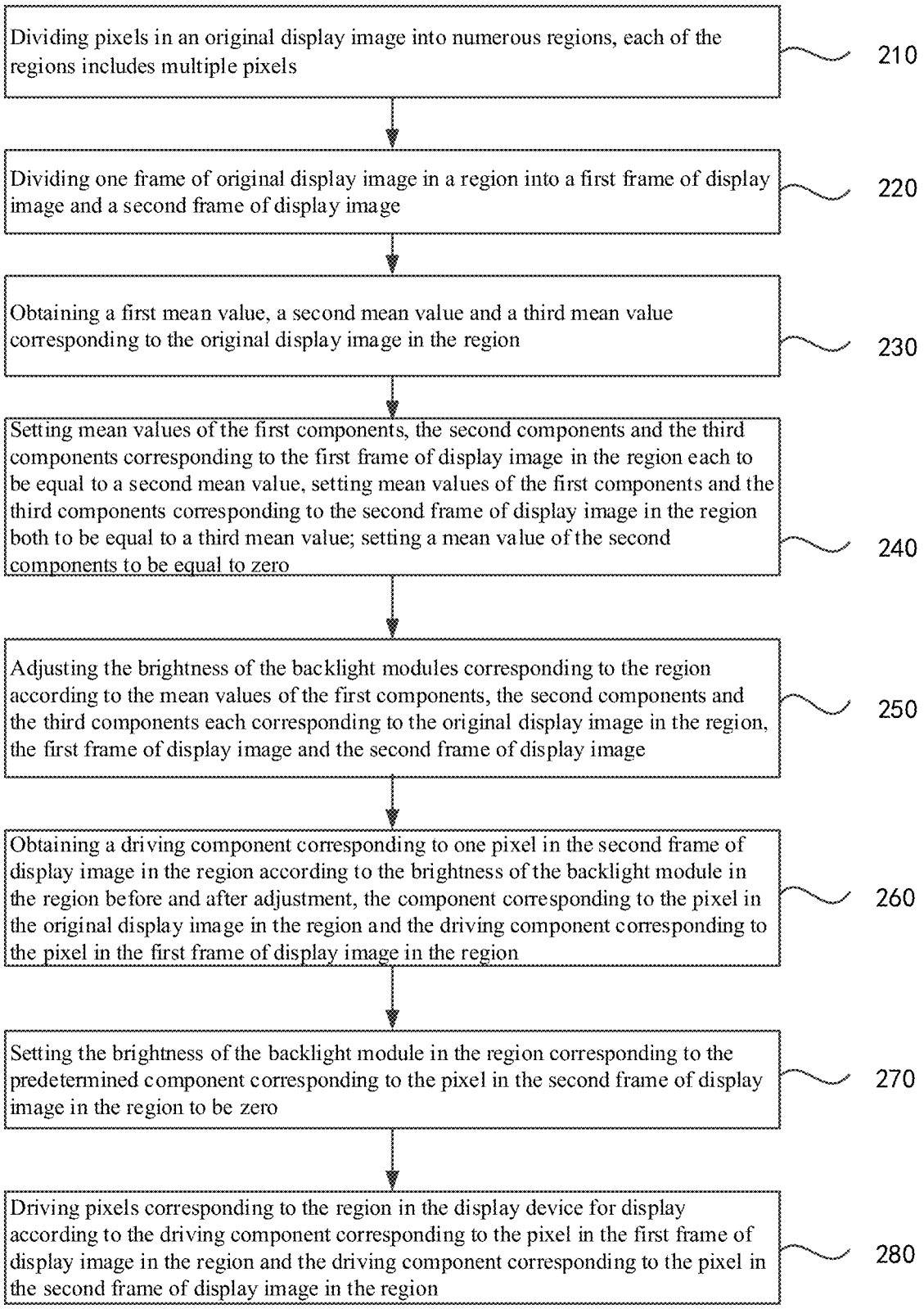
FIG. 2 is a schematic flowchart of a driving method for another display device according to an embodiment.

FIG. 2 is a schematic flowchart of a driving method for a display device according to an embodiment of the disclosure. The driving method can be applied in circumstance in need for driving the display device for displaying and fulfilled by the display device of the embodiment of the disclosure. The method includes:

Step 210, dividing the pixel in the original display image into numerous regions; each of the regions includes multiple pixels.

The original display image can include numerous pixels arranged in a matrix to divide the pixel in the original display image into numerous regions; each region can include multiple rows and multiple columns of pixels.

Step 220, dividing one frame of original display image in a region into the first frame of display image and the second frame of display image.

Exemplarily, one frame of original display image in one divided region can be divided into the first frame of display image and the second frame of display image. Each pixel in the original display image in the region, the first frame of display image and the second frame of display image includes the first component, the second component and the third component corresponding to the predetermined color space.

Step 230, obtaining the first mean value, the second mean value and the third mean value corresponding to the original display image in the region.

The mean values of the first components, the second components and the third components corresponding to all the pixels in the original display image in the region can be set to be the first mean value, the second mean value and the third mean value corresponding to the original display image; the first mean value is larger than the second mean value, and the second mean value is larger than the third mean value.

Step 240, setting the mean values of the first components, the second components and the third components corresponding to the first frame of display image in the region each to be equal to the second mean value, setting the mean values of the first components and the third components corresponding to the second frame of display image in the region both to be equal to the third mean value; the mean value of the second components is equal to zero.

Exemplarily, the first mean value corresponding to the original display image in the region can be set to be A, the second mean value can be B, the third mean value can be C; A is larger than B, B is larger than C. The mean values of the first components, the second components and the third components corresponding to the first frame of display image in the region each can be set to be B. The mean values of the first components and the third components corresponding to the second frame of display image in the region both can be set to be C. The mean value of the second components corresponding to the second frame of display image is set to be zero.

Step 250, adjusting the brightness of the backlight modules corresponding to the region according to the mean values of the first components, the second components and the third components each corresponding to the original display image in the region, the first frame of display image and the second frame of display image.

Exemplarily, the backlight modules can be set to include the first backlight module, the second backlight module and the third backlight module. The brightness of the first backlight module corresponding to the region is adjusted according to the grayscale brightness values of the mean values of the first components corresponding to each of the original display image in the region, the first frame of display image and the second frame of display image. The brightness of the second backlight module corresponding to the region is adjusted according to the grayscale brightness values of the mean values of the second components corresponding to each of the original display image in the region, the first frame of display image and the second frame of display image. The brightness of the third backlight module corresponding to the region is adjusted according to the grayscale brightness values of the mean values of the third components corresponding to each of the original display image in the region, the first frame of display image and the second frame of display image. The computational manner of the backlight brightness specifically is similar to the computational manner of AR1, AG1 and AB1 in step 140, without further repeat herein.

Figure 3:
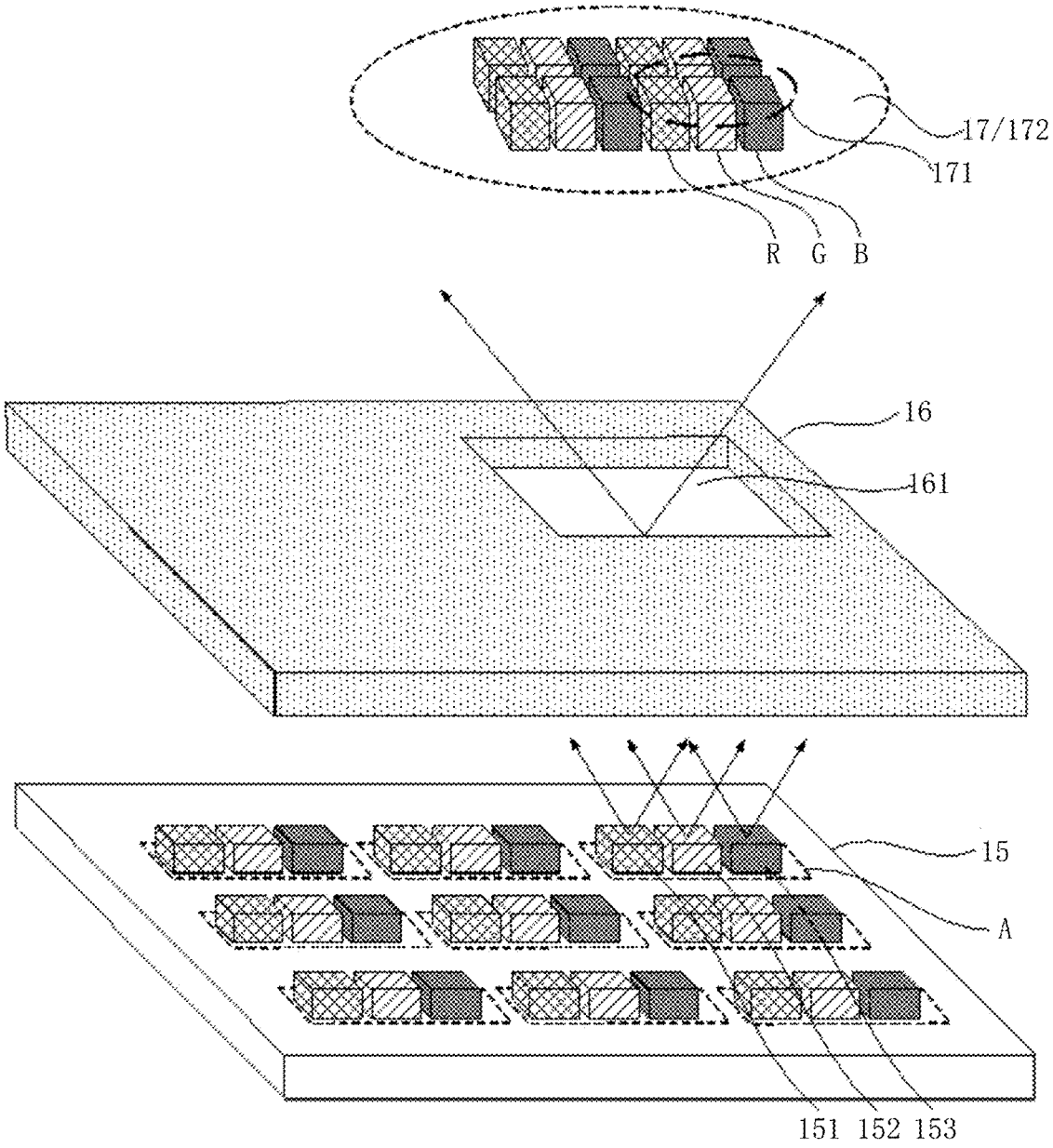
FIG. 3 is a structural schematic view of a display device according to an embodiment.

Exemplarily, FIG. 3 is a structural schematic view of a display device according to an embodiment of the disclosure. The display device can be a liquid crystal display device, as shown in FIG. 3. The display device can include a display panel and a backlight module 15 located below the display panel. The backlight module 15 is configured to provide light to the display panel for display. The display panel can include an array substrate 16 adjacent to the backlight module, and a color filter substrate 17 (merely showing a partial region) located on a side of the array substrate facing away from the backlight module 15. The backlight module 15 can include numerous red backlight modules 151, green backlight modules 152 and blue backlight modules 153; the color filter substrate 17 correspondingly includes numerous pixels 171 (FIG. 3 exemplarily shows four pixels 171). Each of the pixels 171 includes a red pixel R, a green pixel G and a blue pixel B. Light from the backlight module 15 can be emitted on a liquid crystal layer (not shown) located between the array substrate 16 and the color filter substrate 17 through an aperture region 161 in the array substrate 16 to fulfill the function of the liquid crystal display panel.

Exemplarily, as shown in FIG. 3, the region of dividing pixels in the original display image can be set to be corresponding to the region 172 formed by pixels in FIG. 3, and the corresponding region 172 can be disposed with a backlight module region A consisting of a group of red backlight modules 151, green backlight modules 152 and blue backlight modules 153. The brightness of the backlight module corresponding to the region is adjusted according to the mean value of the first component, the second component and the third component corresponding to the original display image, the first frame of display image and the second frame of display image in the region corresponding to the region 172 formed by pixels, namely adjusting the brightness of the red backlight module 151, the green backlight module 152 and the blue backlight module 153 in the backlight module region A.

Step 260, obtaining the driving component corresponding to one pixel in the second frame of display image in the region according to the brightness of the backlight module in the region before and after adjustment, the component corresponding to the pixel in the original display image in the region and the driving component corresponding to the pixel in the first frame of display image in the region.

Exemplarily, the driving component of the first component corresponding to one pixel in the second frame of display image in the region can be obtained according to the brightness of the first backlight module corresponding to the region before and after adjustment, the first component corresponding to the pixel in the original display image in the region and the driving component corresponding to the pixel in the first frame of display image in the region; the driving component of the second component corresponding to the pixel in the second frame of display image in the region is obtained according to the brightness of the second backlight module corresponding to the region before and after adjustment, the second component corresponding to the pixel in the original display image in the region and the driving component corresponding to the pixel in the first frame of display image in the region; the driving component of the third component corresponding to the pixel in the second frame of display image in the region can be obtained according to the brightness of the third backlight module corresponding to the region before and after adjustment, the third component corresponding to the pixel in the original display image in the region and the driving component corresponding to the pixel in the first frame of display image in the region. The computational manner of the driving components of the first component, the second component and the third component corresponding to the pixel in the second frame of display image in the region specifically is similar to the computational manner of TR3, TG3, TB3, TR31, TG31 and TB31 in step 150 without further repeat herein.

Step 270, setting the brightness of the backlight module in the region corresponding to the predetermined component corresponding to the pixel in the second frame of display image in the region to be zero. The predetermined component corresponds to the secondary maximal component corresponding to the pixel in the original display image in the region.

Referring to step 160, when the predetermined component corresponding to the pixel in the second frame of display image in the region is a green component, namely the green component corresponds to the secondary maximal component corresponding to the pixel in the original display image, the brightness of the green backlight module corresponding to the region can be set to be zero. Exemplarily, referring to FIG. 3, the region formed with pixels can be disposed to correspond to the region 172 formed by the pixels 171 on the color filter substrate; the brightness of the green backlight module 152 in the backlight module region A can be set to be zero to play a function of saving energy. Equally, when the predetermined component corresponding to the pixel in the second frame of display image in the region is a red component, namely the red component corresponds to the secondary maximal component corresponding to the pixel in the original display image, the brightness of the red backlight module corresponding to the region can be set to be zero. When the predetermined component corresponding to the pixel in the second frame of display image in the region is a blue component, namely the blue component corresponds to the secondary maximal component corresponding to the pixel in the original display image, the brightness of the blue backlight module corresponding to the region can be set to be zero.

Step 280, driving pixels corresponding to the region in the display device for display according to the driving component corresponding to the pixel in the first frame of display image in the region and the driving component corresponding to the pixel in the second frame of display image in the region.

The pixels corresponding to the region in the display device are driven for display according to the driving component corresponding to the pixels in the second frame of display image in the region and the driving component corresponding to the pixel in the first frame of display image in the region obtained in step 260. The pixels in the original display image are divided into multiple regions to preciously adjust the backlight module brightness in the display device and control the driving component corresponding to the pixels in the first frame of display image and the second frame of display image.

The drawings accompanying embodiments of the disclosure purely depict sizes of each component exemplarily, rather than practical sizes of each component in the display panel.

Figure 4:
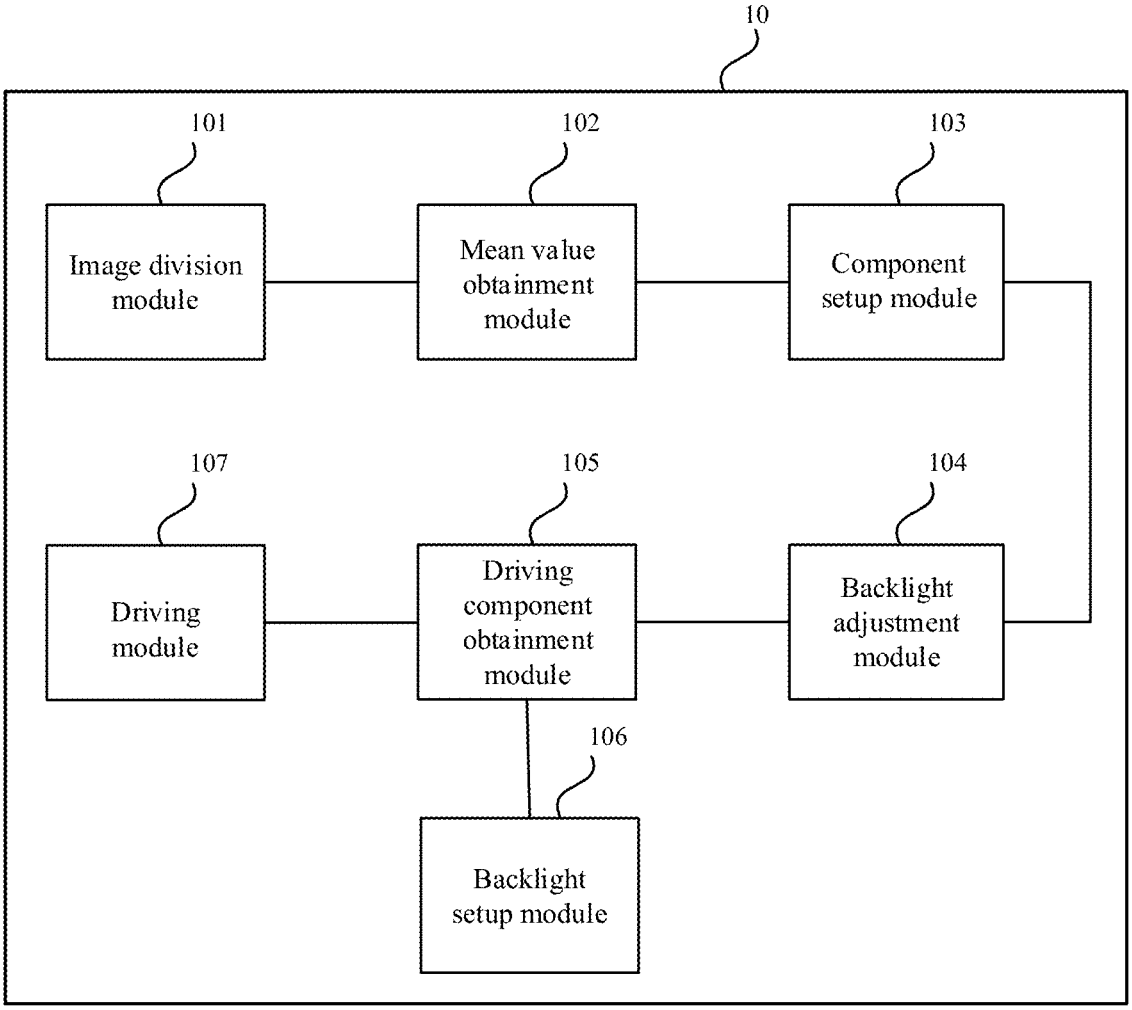
FIG. 4 is a structural schematic view of another display device according to an embodiment.

FIG. 4 is a structural schematic view of a display device according to an embodiment. One frame of original display image of the display device includes at least one region. Each region includes numerous pixels. As shown in FIG. 4, the display device 10 includes an image division module 101, a mean value obtainment module 102, a component setup module 103, a backlight adjustment module 104, a driving component obtainment module 105, a backlight setup module 106 and a driving module 107. The mean value obtainment module 102 is electrically connected to each of the image division module 101 and the component setup module 103. The backlight adjustment module 104 is electrically connected to each of the component setup module 103 and the driving component obtainment module 105. The backlight setup module 106 is electrically connected to each of the driving component obtainment module 105 and the backlight module. The driving module 107 is electrically connected to the driving component obtainment module 105.

The image division module 101 is configured to divide one frame of original display image in one region into the first frame of display image and the second frame of display image. Each pixel in the original display image, the first frame of display image and the second frame of display image includes components corresponding to the predetermined color space. The components include the first components, the second components and the third components. The mean value obtainment module 102 is configured to obtain the first mean value, the second mean value and the third mean value corresponding to the original display image in the region. The first mean value, the second mean value and the third mean value each are the mean values of the first components, the second components and the third components corresponding to the original display image, and the first mean value is larger than the second mean value, the second mean value is larger than the third mean value. The component setup module 103 is configured to set the mean values of the first components, the second components and the third components corresponding to the first frame of display image in the region to be equal to the second mean value, and set the mean values of the first components and the third components corresponding to the second frame of display image to be equal to the third mean value; the mean value of the second components is zero. The backlight adjustment module 104 is configured to adjust the brightness of the backlight module according to the mean values of the first components, the second components and the third components corresponding to the original display image in the region, the first frame of display image and the second frame of display image. The driving component obtainment module 105 is configured to obtain the driving component corresponding to the pixel in the second frame of display image according to the brightness of the backlight module corresponding to the region before and after adjustment, the component corresponding to the pixel in the original display image and the driving component corresponding to the pixel in the first frame of display image. The driving component corresponding to the pixel in the first frame of display image is equal to the secondary maximal component corresponding to the pixel in the original display image. The backlight setup module 106 is configured to set the brightness of the backlight module corresponding to the predetermined component corresponding to the pixel in the second frame of display image in the region to be zero. The predetermined component corresponds to the secondary component corresponding to the pixel in the original display image. The driving module 107 is configured to drive pixels in the display device for display according to the driving component corresponding to pixel in the first frame of display image in the region and the driving component corresponding to the pixel in the second frame of display image.

Optionally, the display device can further include a component judgement module. The component judgement module is configured to judge the relation of the driving component corresponding to the pixel in the second frame of display image in the region and zero, as well as the first component corresponding to the pixel in the original display image. If the driving component corresponding to the pixel in the obtained second frame of display image is smaller than zero, the driving component corresponding to the pixel in the second frame of display image is set to be zero; if the driving component corresponding to the pixel in the obtained second frame of display image is larger than the maximal component corresponding to the pixel, the driving component corresponding to the pixel in the second frame of display image is set to be equal to the maximal component corresponding to the pixel.

Figure 5:
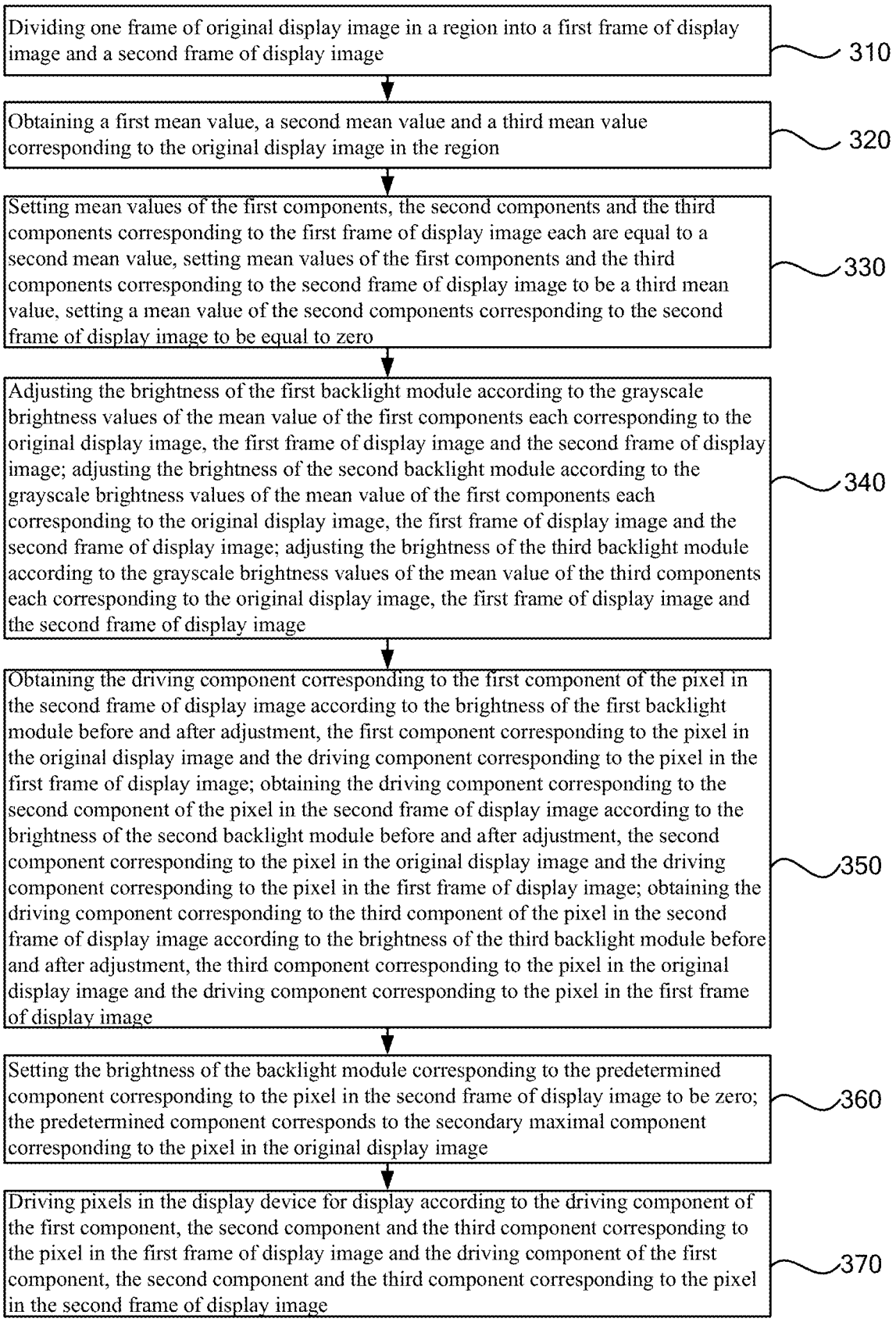
FIG. 5 is a schematic flowchart of a driving method for another display device according to an embodiment.

FIG. 5 is a schematic flowchart of a driving method for a display device according to an embodiment of the disclosure. The driving method can be applied in circumstance in need for driving the display device for displaying and fulfilled by the display device of the embodiment of the disclosure. One frame of original display image of the display device includes at least one region, each region includes numerous pixels. The method includes:

step 310, dividing one frame of original display image in a region into the first frame of display image and the second frame of display image. Each pixel in the original display image, the first frame of display image and the second frame of display image includes components corresponding to the predetermined color space. The components include the first components, the second components and the third components.

Step 320, obtaining the first mean value, the second mean value and the third mean value corresponding to the original display image in the region. The first mean value, the second mean value and the third mean value each are the mean values of the first components, the second components and the third components corresponding to the original display image, and the first mean value is larger than the second mean value, the second mean value is larger than the third mean value.

Step 330, setting the mean values of the first components, the second components and the third components corresponding to the first frame of display image each are equal to the second mean value, setting mean values of the first components and the third components corresponding to the second frame of display image to be the third mean value. The mean value of the second components corresponding to the second frame of display image is equal to zero.

Step 340, adjusting the brightness of the first backlight module according to the grayscale brightness values of the mean value of the first components each corresponding to the original display image, the first frame of display image and the second frame of display image; adjusting the brightness of the second backlight module according to the grayscale brightness values of the mean value of the first components each corresponding to the original display image, the first frame of display image and the second frame of display image; adjusting the brightness of the third backlight module according to the grayscale brightness values of the mean value of the third components each corresponding to the original display image, the first frame of display image and the second frame of display image.

Step 350, obtaining the driving component corresponding to the first component of the pixel in the second frame of display image according to the brightness of the first backlight module before and after adjustment, the first component corresponding to the pixel in the original display image and the driving component corresponding to the pixel in the first frame of display image; obtaining the driving component corresponding to the second component of the pixel in the second frame of display image according to the brightness of the second backlight module before and after adjustment, the second component corresponding to the pixel in the original display image and the driving component corresponding to the pixel in the first frame of display image; obtaining the driving component corresponding to the third component of the pixel in the second frame of display image according to the brightness of the third backlight module before and after adjustment, the third component corresponding to the pixel in the original display image and the driving component corresponding to the pixel in the first frame of display image. The driving components corresponding to the first component, the second component and the third component of the pixel in the first frame of display image are all equal to the secondary maximal component corresponding to the pixel in the original display image.

Step 360, setting the brightness of the backlight module corresponding to the predetermined component corresponding to the pixel in the second frame of display image to be zero. The predetermined component corresponds to the secondary maximal component corresponding to the pixel in the original display image.

Step 370, driving pixels in the display device for display according to the driving component of the first component, the second component and the third component corresponding to the pixel in the first frame of display image and the driving component of the first component, the second component and the third component corresponding to the pixel in the second frame of display image.

The embodiment of the disclosure divides one frame of display image into the first frame of display image and the second frame of display image, and detaches the first component with the maximal grayscale value in the original display image into two components with relatively small grayscale values in the first frame of display image and the second frame of display image, the grayscale brightness value ratio of the primary color component of the pixel is improved cooperated with adjusting the backlight brightness, namely enhancing the grayscale brightness ratio of the primary color component compared with other components at side visual angles, and the color shown by the display panel is approaching the primary color to reduce the color shift of the display panel at large visual angles. Meanwhile, the third component with the minimal grayscale value in the original display image is detached into the component with the maximal component in the first frame of display image and the third component in the second frame of display image. Combined with the adjustment of the backlight module brightness, the problems of the more visible difference of primary component of low grayscale pixels than other components at the front angle and large visual angles compared with the high grayscale pixels and the color shift of display panel at large visual angles can be prevented. Moreover, the brightness of the backlight module of the predetermined component corresponding to the pixel in the second frame of display image is set to be zero for reducing the energy consumption of the display device, resulting in saving energy.

One embodiment further provides a memory readable over computer, stored with commands executable on computer. The commands executable on computer can work to fulfill any of the methods above.

Figure 6:
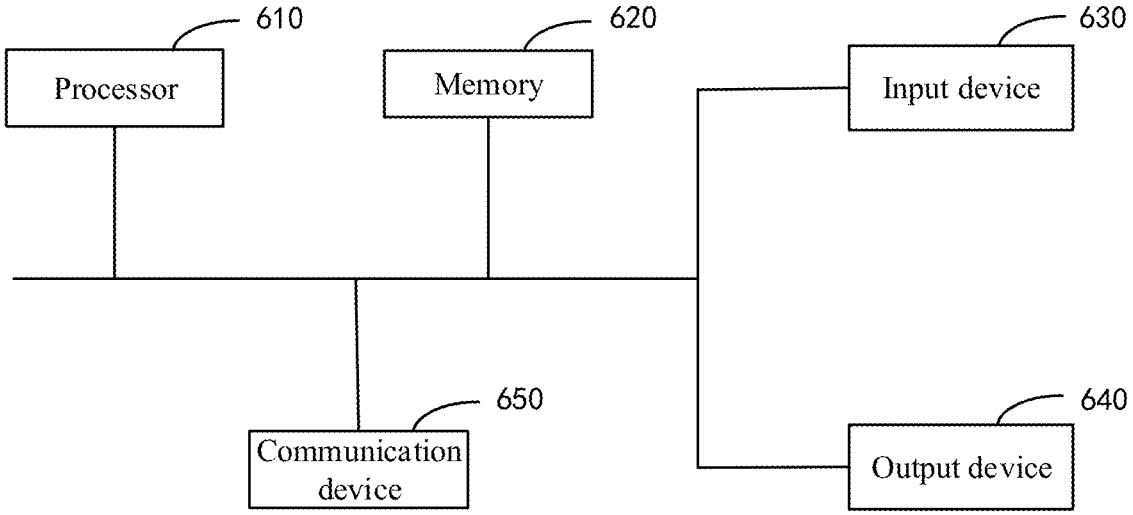
FIG. 6 is a hardware structural schematic view of a display device according to an embodiment.

FIG. 6 is a hardware structural schematic view of a display device according to an embodiment. As shown in FIG. 6, the display device includes: one or more processor(s) 610 and memories 620. FIG. 6 takes one processor 610 as an example.

The display device further can include: an input device 630 and an output device 640.

The processor 610, the memory 620, the input device 630 and the output device 640 in the display device can be connected by a bus line or other manners. FIG. 6 takes connecting by the bus line as an example.

The input device 630 can receive input numbers or character information. The output device 640 can include a display device such as a display screen.

The memory 620 as a storing medium readable over computer can be used to store software programs, programs executable over computer and modules. The processor 610 manipulates various functions and data processes by running the software programs stored in the memory 620, commands and modules to fulfill any of the methods in the embodiments above.

The memory 620 can include a program storage region and a data storage region. The program storage region can store an operating system, at least one application program in need for the function; the data storage region can store data created according to the usage of the display device. Moreover, the memory can include a volatile memory such as random access memory (RAM), further can include a nonvolatile memory such as at least one magnetic disk memory, flash memory or other non-transient solid-state memory.

The memory 620 can be a non-transient computer storage medium or transient computer storage medium. The non-transient computer storage medium, such as at least one magnetic disk memory, flash memory or other nonvolatile solid-state memories. In some embodiments, the memory 620 is optional to include a memory disposed remotely with respect to the processor 610. The remote memories can be connected to the display device by networks. The networks can include the internet, the enterprise intranet, the local area network, the mobile communications network and the combinations thereof.

The input device 630 can be configured to receive input numbers or character information, and generate key signal input related to user setup of the display device and function control. The output device 640 can include a display device such as a display screen.

The display device of the embodiment can further include a communication device 650 to transmit and/or receive information by the communication network.

A person skilled in the art can understand all or partial procedure of the method in the embodiments above to be fulfilled by running computer programs to execute relative hardware. The program can be stored in a non-transient storage medium readable over computer. When the program works, the procedure of the methods of the embodiments above can be included. The non-transient storage medium readable over computer can be a magnetic disk, an optical disk, a read only memory (ROM) or a random access memory (RAM).

What is claimed is:

1. A driving method for a display device, wherein a frame of original display image of the display device comprises at least one region, each of the at least one region comprises a plurality of pixels, the driving method comprises:

dividing the frame of original display image in the at least one region into a first frame of display image and a second frame of display image; wherein each of the plurality of pixels in the original display image, the first frame of display image and the second frame of display image comprises components corresponding to a predetermined color space, the components comprise first components, second components and third components;

obtaining a first mean value, a second mean value and a third mean value corresponding to the original display image in the at least one region; wherein the first mean value, the second mean value and the third mean value each are mean values of the first components, the second components and the third components corresponding to the original display image, and the first mean value is larger than the second mean value, the second mean value is larger than the third mean value;

setting each of the mean values of the first components, the second components and the third components corresponding to the first frame of display image in the at least one region to be equal to the second mean value, setting mean values of the first components and the third components corresponding to the second frame of display image both to be equal to the third mean value, setting a mean value of the second components corresponding to the second frame of display image to be equal to zero;

adjusting a brightness of backlight modules according to the mean values of the first components, the second components and the third components each corresponding to the original display image, the first frame of display image and the second frame of display image in the at least one region;

obtaining a driving component corresponding to the plurality of pixels in the second frame of display image according to brightnesses of the backlight modules before and after adjustment corresponding to the at least one region, the components corresponding to one of the plurality of pixels in the original display image and the driving component corresponding to the pixel in the first frame of display image; wherein the driving component corresponding to the pixel in the first frame of display image is equal to a secondary maximal component corresponding to the pixel in the original display image;

setting the brightness of the backlight modules corresponding to a predetermined component corresponding to the pixel in the second frame of display image in the at least one region to be zero; wherein the predetermined component corresponds to the secondary maximal component corresponding to the pixel in the original display image;

driving the plurality of pixels in the display device for display according to the driving component corresponding to the plurality of pixels in the first frame of display image and the driving component corresponding to the plurality of pixels in the second frame of display image in the at least one region.

2. The driving method according to claim 1, wherein after obtaining the driving component corresponding to the plurality of pixels in the second frame of display image according to the brightnesses of the backlight modules before and after adjustment corresponding to the at least one region, the components corresponding to one of the plurality of pixels in the original display image and the driving component corresponding to the pixel in the first frame of display image, the driving method further comprises:

judging a relation of the driving component corresponding to the pixel in the second frame of display image in the at least one region, zero and the first components corresponding to the plurality of pixels in the original display image;

when the driving component corresponding to the plurality of pixels in the second frame of display image is smaller than zero, setting the driving component corresponding to the pixel in the second frame of display image to be equal to zero;

when the driving component corresponding to the pixel in the second frame of display image is larger than a maximal component corresponding to the pixel, setting the driving component corresponding to the pixel in the second frame of display image to be equal to the maximal component corresponding to the pixel.

3. The driving method according to claim 1, wherein the backlight modules comprise a first backlight module, a second backlight module and a third backlight module, adjusting the brightness of the backlight modules according to the mean values of the first components, the second components and the third components each corresponding to the original display image, the first frame of display image and the second frame of display image in the at least one region comprises:

adjusting a brightness of the first backlight module according to a grayscale brightness value of a mean value of the first components each corresponding to the original display image in the at least one region, the first frame of display image and the second frame of display image;

adjusting a brightness of the second backlight module according to a grayscale brightness value of a mean value of the second components each corresponding to the original display image in the at least one region, the first frame of display image and the second frame of display image;

adjusting a brightness of the third backlight module according to a grayscale brightness value of a mean value of the third components each corresponding to the original display image in the at least one region, the first frame of display image and the second frame of display image.

4. The driving method according to claim 1, wherein the backlight modules comprise a first backlight module, a second backlight module and a third backlight module, obtaining the driving component corresponding to the plurality of pixels in the second frame of display image according to the brightnesses of the backlight modules before and after adjustment corresponding to the at least one region, the components corresponding to one of the plurality of pixels in the original display image and the driving component corresponding to the pixel in the first frame of display image comprises:

obtaining the driving component of the first components corresponding to the pixel in the second frame of display image according to the brightnesses of the first backlight module before and after adjustment corresponding to the at least one region, the first components corresponding to one of the plurality of pixels in the original display image and the driving component corresponding to the pixel in the first frame of display image;

obtaining the driving component of the second components corresponding to the pixel in the second frame of display image according to the brightnesses of the second backlight module before and after adjustment corresponding to the at least one region, the second components corresponding to one of the plurality of pixels in the original display image and the driving component corresponding to the pixel in the first frame of display image;

obtaining the driving component of the third components corresponding to the pixel in the second frame of display image according to the brightnesses of the third backlight module before and after adjustment corresponding to the at least one region, the third components corresponding to one of the plurality of pixels in the original display image and the driving component corresponding to the pixel in the first frame of display image.

5. The driving method according to claim 1, wherein the predetermined color space is a red-green-blue (RGB) color space.

6. The driving method according to claim 5, wherein the first component, the second component and the third component of the predetermined color space each correspond to a red component, a green component and a blue component in the RGB color space.

7. The driving method according to claim 1, wherein the display device is a liquid crystal display device.

8. A display device, wherein a frame of original display image of the display device comprises at least one region, each of the at least one region comprises a plurality of pixels, the display device comprises:

an image division module, disposed to divide the frame of original display image in one of the plurality of regions into a first frame of display image and a second frame of display image; wherein each of the plurality of pixels in the original display image, the first frame of display image and the second frame of display image comprises components corresponding to a predetermined color space, the components comprise first components, second components and third components;

a mean value obtainment module, electrically connected to the image division module, disposed to obtain a first mean value, a second mean value and a third mean value corresponding to the original display image in the at least one region; wherein the first mean value, the second mean value and the third mean value each are mean values of the first components, the second components and the third components corresponding to the original display image, and the first mean value is larger than the second mean value, the second mean value is larger than the third mean value;

a component setup module, electrically connected to the mean value obtainment module, disposed to set each of the mean values of the first components, the second components and the third components corresponding to the first frame of display image in the at least one region to be equal to the second mean value, set mean values of the first components and the third components corresponding to the second frame of display image both to be equal to the third mean value, and set a mean value of the second components corresponding to the second frame of display image to be equal to zero;

a backlight adjustment module, electrically connected to the component setup module, disposed to adjust a brightness of backlight modules according to the mean values of the first components, the second components and the third components each corresponding to the original display image, the first frame of display image and the second frame of display image in the at least one region;

a driving component obtainment module, electrically connected to the backlight adjustment module, disposed to obtain a driving component corresponding to the plurality of pixels in the second frame of display image according to brightnesses of the backlight modules before and after adjustment corresponding to the at least one region, the components corresponding to one of the plurality of pixels in the original display image and the driving component corresponding to the pixel in the first frame of display image; wherein the driving component corresponding to the pixel in the first frame of display image is equal to a secondary maximal component corresponding to the pixel in the original display image;

a backlight setup module, electrically connected to the backlight module, disposed to set the brightness of the backlight modules corresponding to a predetermined component corresponding to the pixel in the second frame of display image in the at least one region to be zero; wherein the predetermined component corresponds to the secondary maximal component corresponding to the pixel in the original display image;

a driving module, electrically connected to the driving component obtainment module, disposed to drive the plurality of pixels in the display device for display according to the driving component corresponding to the plurality of pixels in the first frame of display image and the driving component corresponding to the plurality of pixels in the second frame of display image in the at least one region.

9. The display device according to claim 8, further comprising:

a component judgement module, disposed to judge a relation of the driving component corresponding to the pixel in the second frame of display image in the at least one region, zero and the first components corresponding to the plurality of pixels in the original display image after obtaining the driving component corresponding to the plurality of pixels in the second frame of display image according to the brightnesses of the backlight modules before and after adjustment corresponding to the at least one region, the components corresponding to one of the plurality of pixels in the original display image and the driving component corresponding to the pixel in the first frame of display image;

wherein when the driving component corresponding to the plurality of pixels in the second frame of display image is smaller than zero, the driving component corresponding to the pixel in the second frame of display image is set to be equal to zero;

wherein when the driving component corresponding to the pixel in the second frame of display image is larger than a maximal component corresponding to the pixel, the driving component corresponding to the pixel in the second frame of display image is set to be equal to the maximal component corresponding to the pixel.

10. The display device according to claim 8, wherein the backlight modules comprise a first backlight module, a second backlight module and a third backlight module, the backlight adjustment module is configured for:

adjusting a brightness of the first backlight module according to a grayscale brightness value of a mean value of the first components each corresponding to the original display image in the at least one region, the first frame of display image and the second frame of display image;

adjusting a brightness of the second backlight module according to a grayscale brightness value of a mean value of the second components each corresponding to the original display image in the at least one region, the first frame of display image and the second frame of display image;

adjusting a brightness of the third backlight module according to a grayscale brightness value of a mean value of the third components each corresponding to the original display image in the at least one region, the first frame of display image and the second frame of display image.

11. The display device according to claim 8, wherein the backlight modules comprise a first backlight module, a second backlight module and a third backlight module, the driving component obtainment module is configured for:

obtaining the driving component of the first components corresponding to the pixel in the second frame of display image according to the brightnesses of the first backlight module before and after adjustment corresponding to the at least one region, the first components corresponding to one of the plurality of pixels in the original display image and the driving component corresponding to the pixel in the first frame of display image;

obtaining the driving component of the second components corresponding to the pixel in the second frame of display image according to the brightnesses of the second backlight module before and after adjustment corresponding to the at least one region, the second components corresponding to one of the plurality of pixels in the original display image and the driving component corresponding to the pixel in the first frame of display image;

obtaining the driving component of the third components corresponding to the pixel in the second frame of display image according to the brightnesses of the third backlight module before and after adjustment corresponding to the at least one region, the third components corresponding to one of the plurality of pixels in the original display image and the driving component corresponding to the pixel in the first frame of display image.

12. The display device according to claim 8, wherein the predetermined color space is an RGB color space.

13. The display device according to claim 12, wherein the first component, the second component and the third component of the predetermined color space each correspond to a red component, a green component and a blue component in the RGB color space.

14. The display device according to claim 8, wherein the display device is a liquid crystal display device.

15. A driving method for a display device, wherein a frame of original display image of the display device comprises at least one region, each of the at least one region comprises a plurality of pixels, the driving method comprises:

dividing the frame of original display image in the at least one region into a first frame of display image and a second frame of display image; wherein each of the plurality of pixels in the original display image, the first frame of display image and the second frame of display image comprises components corresponding to a predetermined color space, the components comprise first components, second components and third components;

obtaining a first mean value, a second mean value and a third mean value corresponding to the original display image in the at least one region; wherein the first mean value, the second mean value and the third mean value each are mean values of the first components, the second components and the third components corresponding to the original display image, and the first mean value is larger than the second mean value, the second mean value is larger than the third mean value;

setting each of the mean values of the first components, the second components and the third components corresponding to the first frame of display image in the at least one region to be equal to the second mean value, setting mean values of the first components and the third components corresponding to the second frame of display image both to be equal to the third mean value, setting a mean value of the second components corresponding to the second frame of display image to be equal to zero;

adjusting a brightness of the first backlight module according to a grayscale brightness value of a mean value of the first components each corresponding to the original display image in the at least one region, the first frame of display image and the second frame of display image; adjusting a brightness of the second backlight module according to a grayscale brightness value of a mean value of the second components each corresponding to the original display image in the at least one region, the first frame of display image and the second frame of display image; adjusting a brightness of the third backlight module according to a grayscale brightness value of a mean value of the third components each corresponding to the original display image in the at least one region, the first frame of display image and the second frame of display image;

obtaining the driving component of the first components corresponding to the pixel in the second frame of display image according to the brightnesses of the first backlight module before and after adjustment corresponding to the at least one region, the first components corresponding to one of the plurality of pixels in the original display image and the driving component corresponding to the pixel in the first frame of display image; obtaining the driving component of the second components corresponding to the pixel in the second frame of display image according to the brightnesses of the second backlight module before and after adjustment corresponding to the at least one region, the second components corresponding to one of the plurality of pixels in the original display image and the driving component corresponding to the pixel in the first frame of display image; obtaining the driving component of the third components corresponding to the pixel in the second frame of display image according to the brightnesses of the third backlight module before and after adjustment corresponding to the at least one region, the third components corresponding to one of the plurality of pixels in the original display image and the driving component corresponding to the pixel in the first frame of display image; wherein each of the driving components corresponding to the first components, the second components and the third components of the pixel in the first frame of display image is equal to a secondary maximal component corresponding to the pixel in the original display image;

setting the brightness of the backlight modules corresponding to a predetermined component corresponding to the pixel in the second frame of display image in the at least one region to be zero; wherein the predetermined component corresponds to the secondary maximal component corresponding to the pixel in the original display image;

driving the plurality of pixels in the display device for display according to the driving components of the first components, the second components and the third components corresponding to the pixel in the first frame of display image in the at least one region and the driving components of the first components, the second components and the third components corresponding to the pixel in the second frame of display image.

16. The driving method according to claim 15, wherein after obtaining the driving component of the third components corresponding to the pixel in the second frame of display image according to the brightnesses of the third backlight module before and after adjustment corresponding to the at least one region, the third components corresponding to one of the plurality of pixels in the original display image and the driving component corresponding to the pixel in the first frame of display image, the driving method further comprises:

judging a relation of the driving component corresponding to the pixel in the second frame of display image in the at least one region, zero and the first components corresponding to the plurality of pixels in the original display image;

when the driving component corresponding to the plurality of pixels in the second frame of display image is smaller than zero, setting the driving component corresponding to the pixel in the second frame of display image to be equal to zero;

when the driving component corresponding to the pixel in the second frame of display image is larger than a maximal component corresponding to the pixel, setting the driving component corresponding to the pixel in the second frame of display image to be equal to the maximal component corresponding to the pixel.

17. The driving method according to claim 15, wherein the predetermined color space is an RGB color space.

18. The driving method according to claim 17, wherein the first component, the second component and the third component of the predetermined color space each correspond to a red component, a green component and a blue component in the RGB color space.

19. The driving method according to claim 15, wherein the display device is a liquid crystal display device.

20. The driving method according to claim 1, wherein a storage medium readable over computer is stored with an executable command over computer, and the executable command over computer executes the driving method.

* * * * *